US006880464B2

(12) United States Patent
Haeselich

(10) Patent No.: US 6,880,464 B2
(45) Date of Patent: Apr. 19, 2005

(54) IGNITER FOR A PROJECTILE WHICH IS FIRED FROM A BARREL WITH ANGULAR MOMENTUM

(75) Inventor: Detlef Haeselich, Muessen (DE)

(73) Assignee: Nico-Pyrotechnik Hans-Juergen Diederichs GmbH & Co. KG, Trittau (DE)

( * ) Notice: Subject to any disclaimer, the term of this patent is extended or adjusted under 35 U.S.C. 154(b) by 0 days.

(21) Appl. No.: 10/471,869

(22) PCT Filed: Mar. 12, 2002

(86) PCT No.: PCT/DE02/00864

§ 371 (c)(1),
(2), (4) Date: Nov. 6, 2003

(87) PCT Pub. No.: WO02/073119

PCT Pub. Date: Sep. 19, 2002

(65) Prior Publication Data

US 2004/0074411 A1 Apr. 22, 2004

(30) Foreign Application Priority Data

Mar. 12, 2001 (DE) ..... 101 11 714

(51) Int. Cl.[7] ..... F42C 15/26
(52) U.S. Cl. ..... 102/231
(58) Field of Search ..... 102/231, 235, 102/236, 237, 244, 245

(56) References Cited

U.S. PATENT DOCUMENTS 2,164,797 A * 7/1939 Birkigt ..... 102/205
3,640,225 A * 2/1972 Carlson et al. ..... 102/237
3,750,589 A * 8/1973 Egli et al. ..... 102/237
4,432,283 A * 2/1984 Duffner ..... 102/244
4,677,914 A * 7/1987 Apotheloz ..... 102/233
4,744,298 A * 5/1988 Popovitch ..... 102/235
4,938,138 A * 7/1990 Maruska ..... 102/235
5,033,382 A * 7/1991 Webb ..... 102/235

FOREIGN PATENT DOCUMENTS

DE A1-2 037 182 2/1972

* cited by examiner

*Primary Examiner*—Teri Pham Luu
*Assistant Examiner*—Bret Hayes
(74) *Attorney, Agent, or Firm*—Milde & Hoffberg, LLP

(57) ABSTRACT

The igniter comprises a disk-shaped element (15) with a central portion (16) and a boundary portion (17) surrounding it for interrupting and/or releasing an ignition chain (13*a*, 13*b*) of the igniter. Only the central portion interrupts the chain of ignition and is supported by a holding device (19). A collecting space is provided around the holding device which, seen in the direction of flight of the projectile, is located below the boundary portion (17). The central portion (16) and the boundary portion (17) are connected with each other by means of a rated breaking point (18). Upon the initial acceleration of the projectile the boundary portion (17) is sheared off from the central portion (16) and received in the collecting space (21), whereupon the central portion (16) is also subsequently removed from the ignition chain (13*a*, 13*b*) by the twist of the projectile.

15 Claims, 2 Drawing Sheets

IGNITER FOR A PROJECTILE WHICH IS FIRED FROM A BARREL WITH ANGULAR MOMENTUM

BACKGROUND OF THE INVENTION

The invention relates to an igniter for a projectile to be fired out of a barrel with twist, comprising an ignition chain triggering an active effect.

Such projectiles have an ignition chain consisting e.g. of several pyrotechnical charges for triggering an active effect and are provided with a safety device that interrupts the ignition chain in a first position and, upon the firing of the projectile, passes over from this first position into a second position releasing the ignition chain due to the initial acceleration of the projectile and/or its twist. Thus, it is excluded that all components of the ignition chain are ignited although the projectile is in rest, e.g. still in the barrel.

An igniter for projectiles is known from DE-A1-20 37 182, which comprises a safety device with disk-shaped elements, e.g. a plastically deformable plate. This plate is disposed between a body containing the ignition composition and that part of the projectile that contains an opening leading to the charge to be ignited. It is to be prevented with this arrangement that, in the case of an unintentional igniting of the primer, in the safety position of the body receiving it, the charge of explosives of the projectile is ignited. In the case of an unintentional igniting of the primer, the hot explosion gases impact on the plastically deformable plate at a high pressure, whereby it is deformed and firmly pressed into the parting lines between the carrier for the primer and the parts receiving it so that the hot explosion gases reach the opening leading to the charge of explosives.

Such projectiles are also used as so-called irritation ammunition, e.g. for surprising criminals or for fighting violent demonstrators. This irritation ammunition is derived from live ammunition and is e.g. a cartridge ammunition with a 40 mm caliber. CS, tear gas, smoke, star-generating charges, flash charges, etc. are e.g. used as active effects. This irritation ammunition comprises an impact igniter that ignites the active effect upon impact. Should this igniter not function for once, it must be ensured that the active effect is nevertheless triggered at least after a certain period of time or is self-disintegrating in order to make the safe removal of the irritation ammunition possible. For this purpose, an additional safety igniter with an ignition chain is provided that consists of at least one igniter ignited upon the firing of the irritation projectile and at least a further charge, in particular a delayed-action charge, through which, after its burn-up, the actual active charge is ignited, for instance, through safety fuses or booster charges approximately four second after the firing.

Mostly, such irritation ammunition is fired out of short-barrel weapons and/or short revolving magazines. The magazine is usually covered by a disk in magazine weapons, which only releases the cartridge to be actually fired, whereas all other magazine barrels are covered by the disk.

If the propelling charge is not ignited upon the attempted firing of the irritation ammunition, it may happen that the delayed-action charge for the safety igniter is nevertheless ignited, e.g. by a too weak propelling charge or by the priming cap alone. Since, now, the irritation ammunition does not leave the barrel of the firing weapon, be it a normal barrel weapon or a magazine weapon, the active effect is triggered after the predetermined delay time of about 4 seconds. This may be connected with a high risk of injury for persons loitering about or the firer him- or herself, in particular if a magazine weapon is used. As soon as a shot is triggered, the magazine revolver is further rotated by one position although the projectile does not leave the magazine, so that the magazine barrel in which the cartridge ammunition with burning off delayed-action igniting chain is located is closed at the front. If then, after the predetermined delay time, the active effect is triggered, such as the releasing of tear gas, it can practically only exit towards the rear in the direction of the firer so that a high risk of injury is given for him or her.

SUMMARY OF THE INVENTION

Consequently, it would be desirable to insert a safety device into the ignition chain for triggering the active effect, which interrupts the ignition chain in a first position and, upon the firing of the projectile passes over from this first position into a second position releasing the ignition charge due to the initial acceleration of the projectile and/or its twist. A plurality of variants of such safety devices are known for projectile igniters.

The invention is based on the object of indicating such a safety device for a projectile of the type in question, which is of a simple construction, is inexpensive to produce and which reliably ensures that the active effect actually is only ignited if the projectile has experienced the initial acceleration connected with a firing and the twist.

According to the invention the safety device of the igniter comprises a disk-shaped element with a central portion and a boundary portion surrounding it. Here, only the central portion interrupts the ignition chain and is mechanically supported and kept in place by a holding device. The central portion and the boundary portion are connected with each other by means of a rated breaking point which rips open upon the initial acceleration of the projectile. Moreover, a collecting space is provided around the holding device which receives the boundary portion separated from the central portion at the rated breaking point upon the initial acceleration of the projectile and the central portion subsequently removed from the ignition chain by the twist of the projectile.

Such a safety device for an igniter can be manufactured in a very simple and also inexpensive fashion since the safety device is e.g. a correspondingly prepared simple disk, made of a suitable material such as plastic or metal.

Upon the firing of the projectile, the initial acceleration acts both on the central portion and the boundary portion. Since, however, only the central portion is supported, the boundary portion is sheared off from the central portion at the rated breaking point due to this initial acceleration and falls into the collecting space located behind the boundary portion in the direction of flight of the projectile. Said space has a thickness that corresponds to at least twice the thickness of the boundary portion so that, if the boundary portion is in the collecting space, it is removed from the plane of the central portion. Now, the twist acts on this central portion so that this central portion is removed from the ignition chain more or less soon and the ignition chain is released due to this.

The twist and the twist acceleration are, as a rule, that high that the central portion is located eccentrically to the axis of twist of the projectile with its center of mass due to the remainders of the rated breaking point so that the centrifugal forces remove the central portion from the ignition chain. It is, of course, possible to place the center of mass of the central portion deliberately eccentrically to the axis of twist of the projectile.

The rated breaking point can e.g. be formed by reducing the thickness of material of the disk-shaped element in the limiting area between central portion and boundary portion. Moreover, central portion and boundary portion can be connected with each other through webs. A further possibility is to form central portion and boundary portion in each case as individual elements and to connect them by means of a connection element, e.g. a self-adhesive film that forms the rated breaking point.

For a full understanding of the present invention, reference should now be made to the following detailed description of the preferred embodiments of the invention as illustrated in the accompanying drawings.

DESCRIPTION OF THE PREFERRED EMBODIMENT

Figure 1:
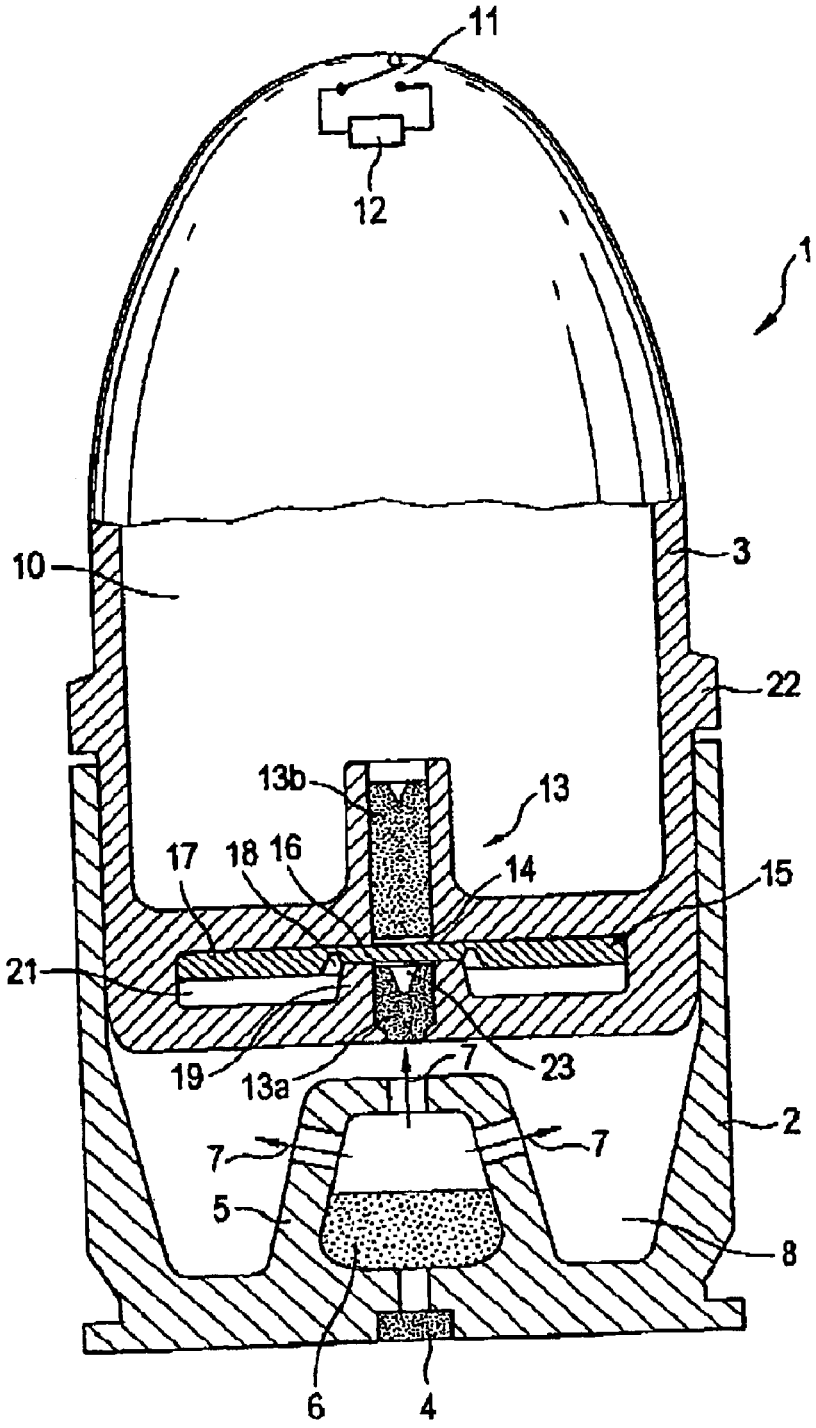
FIG. 1 is a partial sectional view of the irritation ammunition consisting of cartridge case and projectile with a disk-shaped safety device for interrupting the ignition chain for an active effect.

The preferred embodiment of the present invention will now be described with reference to FIGS. 1–5 of the drawings. Identical elements in the various figures are designated with the same reference numerals.

An irritation ammunition with a cartridge case 2 and a projectile inserted in it is represented as a partial sectional view in FIG. 1. A priming cap 4 is disposed at the bottom of cartridge case 2 with which a propelling charge 6 that is located in a container S is ignited. The container 5 comprises overflow openings which open into a pressure chamber 8 between cartridge case 2 and projectile 3.

The projectile 3 comprises a charge chamber 10 in its front, in which an irritation charge, e.g. CS tear gas or the like is located, which can be triggered in a pyrotechnical way. This takes customarily place by means of a impact igniter 11 which, here, is only outlined as a switch and which ignites a pyrotechnical ignition charge 12 upon the impact of the projectile, which, in turn triggers the active charge present in the charge chamber 10.

A delayed-action charge 13 is also ignited with the ignition of the propelling charge 6 by means of its propellants, which, however, is divided into two parts 13*a* and 13*b*. The partial charges 13*a* and 13*b* are separated from each other by a gap 14.

A disk 15 as a safety device for interrupting and/or releasing the ignition chain between the two delayed-action charges 13*a* and 13*b* is inserted into this gap 14, which consists of a central portion 16 and a boundary portion 17 that surrounds it, which are separated from each other by a rated breaking point 18.

The central portion 16 is supported by a holding device, e.g. a base, that surrounds the delayed-action charge 13*a*. The boundary portion 17 is of a greater thickness than the central portion 17, due to which the step between the central portion 16 and the boundary portion 17 is substantially given by the rated breaking point 18, With this step, the disk 15 abuts against the base, whereby the disk 15 is held in its radial position.

Moreover, the disk 15 with its upper side seen in the direction of flight of the projectile 3 abuts against the ceiling of a collecting space 21 in which the disk 15 is laterally held with a small clearance. This collecting space 21 is of a thickness that corresponds to at least twice the thickness of the boundary portion 17 seen in the direction of flight of the projectile.

If the projectile 3 is fired and the propelling charge 6 is duly ignited, a pressure builds up in the pressure chamber 8, due to which the pressure finally increases to such an extent that the connection between cartridge case 2 and projectile 3 is separated and the projectile 3 is expelled from the cartridge case 2. Here, the projectile 3 experiences an acceleration, moreover a twist is imparted to the projectile by means twist elements and rifling elemens of the firing barrel.

Thanks to the initial acceleration of the projectile 3, the rated break point 18 of the disk 15 breaks, whereby the boundary portion 17 is moved against the bottom of the collecting space 21 and preferably clamped in this position. In addition to this, the side wall of the collecting space 21 can e.g. extend inwards in a slightly conical fashion or be roughened, etc. Due to the twist acceleration, the central portion 16 is subsequently also flung outwards from the position blocking the ignition chain and also collected in the collecting space 21 outside the boundary portion 17. Thus, the ignition chain is released in the area of the delayed-action charge 13. The delayed-action charge 13*a* can then ignite the delayed-action charge 13*b* which, in turn, can ignite the active charge in the charge chamber 10. For the ignition of the delayed-action charge 13*b* by the delayed-action charge 13*a*, the delayed-action charge 13*a* may comprise a conical recess in a known fashion, through which the detonation waves within the delayed-action charge 13*a* can be bundled and directed to the delayed-action charge 13*b* in a centered fashion and ignite it.

Should the ignition of the propelling charge 6 be only incomplete and the delayed-action charge 13 be nevertheless ignited, i.e. the projectile does not leave the barrel of the weapon, then no initial acceleration or twist acceleration occurs so that the disk 15 remains in its place and prevents an ignition of the delayed-action charge 13*b* at the end of the burn-up. Thus, the active charge in the charge chamber 10 is also not ignited and the projectile can be removed from the barrel of the weapon without any risk.

After a due firing of the projectile 3, when the boundary portion 17 and, subsequently, the central portion 16 of the disk 15 are collected in the collecting space due to the initial acceleration and/or the twist, the delayed-action charge 13*a* ignites the second delayed-action charge 13*b* of the delayed-action charge 13. If, then, the contact fuse 11 does no function upon contact of the projectile 3 and the active charge in the charge chamber 10 is also not ignited, it is ignited after the burn-up of the delayed-action charge 13*b*.

Figure 2:
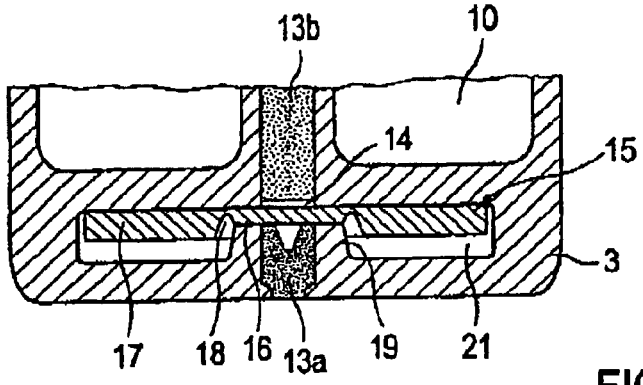
FIG. 2 is a cross-section through the rear area of a projectile with a disk-shaped safety device that is slightly modified with respect to FIG. 1.
Figure 3:
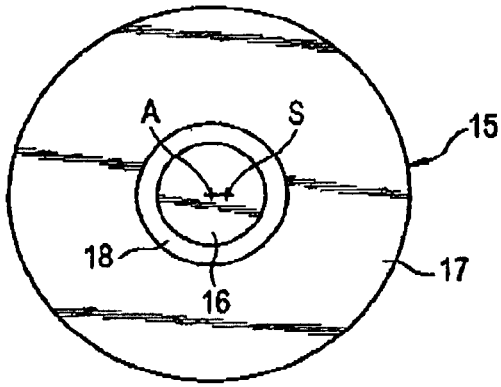
FIG. 3 is a view from below of the disk-shaped safety device according to FIG. 2.

In FIG. 2, the igniter according to FIG. 1 is represented with a slight modification of the disk 15. The circular disk 15 consists again of a central portion 16 and a boundary portion 17 that surrounds it and which is separated from the central portion 16 by a rated breaking point 18 in the form of a notch. As can be gathered from FIG. 3, the center of mass S of the central portion 16 is outside the longitudinal axis and axis of twist A of the projectile.

If, due to the initial acceleration, the boundary portion 17 is sheared off from the central portion 16 and received in the collecting space 21, the central portion 16 is removed from the ignition chain very quickly due to the eccentric position of the center of mass S, so that it can ignite all components of the ignition chain through the delayed-action charges 13*a* and 13*b*.

Figure 4:
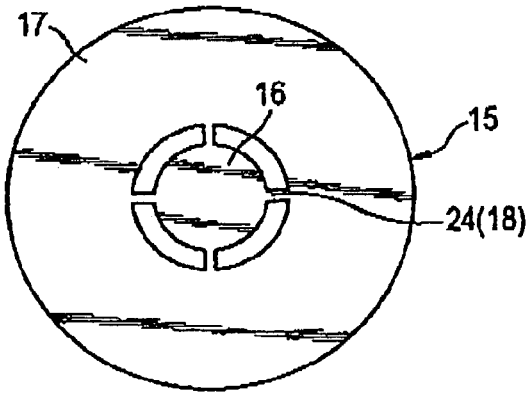
FIG. 4 is another development of the disk-shaped safety device according to the invention.

A disk 15 with a central portion 16 and a boundary portion 17 is represented in FIG. 4, which are connected with each other by means of several webs 24 that form the rated breaking point 18.

Figure 5:
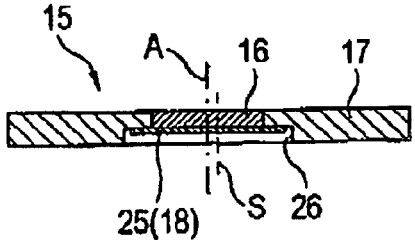
FIG. 5 is a further embodiment of a disk-shaped safety device according to the invention.

A disk 15 is shown in FIG. 5, which, in turn, is composed of a central portion 16 and a boundary portion 17. The central portion 16 and the boundary portion 17 are individual elements, i.e. in the most simple case a small circular disk and/or an annular disk. The annular disk as the boundary portion 17, in turn, is of a greater thickness than the central portion 16. The two individual elements 16 and 17 are connected with each other by means of a self-adhesive plastic film 25 which assumes the function of the rated breaking point 18. In the represented case of FIG. 5 the plastic film 26 is connected to the lower side of the central portion 16 and a step 26 in the boundary portion 17 so that, upon separation of the boundary portion 17 from the central portion 16 upon the initial acceleration of the projectile 3 the plastic film 25 is also detached from the central portion 16. Preferably, the center of mass S of the central portion 16 is again eccentric to the axis of twist A of the projectile 3 so that, after the shearing off of the boundary portion 17, the central portion 16 is rapidly conveyed into the collecting space 21.

It is, of course, possible to also affix the plastic film 25 to the upper side of the disk 15. In each case, the plastic film 25 is designed in such a fashion that it makes an ignition between the delayed-action charges 13*a* and 13*b* possible.

At any rate, the disk 15 should consist of a material with a low specific mass so that only such a slight flyweight is exerted on the projectile 3 due to the small disk received in the collecting space 21 in accordance with the central portion 16 that the flight path of the projectile is not disturbed.

Other developments of the invention, in particular of the shape of disk 15 are possible, e.g. it may be oblong, rectangular or square. Likewise, the base must not be a solid base 19, but it can be implemented by means of e.g. several points of support or supporting portions.

It is essential that the rated breaking point 18 of the disk 15 breaks during the initial acceleration of the projectile 3 in the firing barrel so that, thereafter, the central portion 16 that interrupts the ignition chain is also quickly transported out of the ignition chain.

There has thus been shown and described a novel igniter for a projectile which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. An igniter for a projectile to be fired from a barrel with angular momentum, comprising an ignition chain triggering an active effect, a safety device which, in a first position, interrupts the ignition chain and, upon firing of the projectile, passes over to a second position releasing the ignition chain due to an initial acceleration and angular momemtum of the projectile, wherein the safety device comprises a disk-shaped element having a central portion and a boundary portion surrounding the central portion;

wherein only the central portion of the disk-shaped element interrupts the ignition chain;

wherein the central portion of the disk-shaped element, but not the boundary portion, is supported and kept in place by a holding device;

wherein the central portion and the boundary portion are connected with each other through a rated breaking point or line that tears upon the initial acceleration of the projectile; and wherein a collecting space is provided around the holding device which receives the boundary portion that is separated from the central portion upon the initial acceleration of the projectile and the central portion that is subsequently removed from the ignition chain by rotation of the projectile.

2. The igniter according to claim 1, wherein the holding device is a support for the central portion, which surrounds the ignition chain and wherein the boundary portion has a step which rests against the support and thus secures the disk-shaped element in a first position thereof that interrupts the ignition chain.

3. The igniter according to claim 1, wherein the boundary portion is of a greater thickness than the central portion.

4. The igniter according to claim 1, wherein the collecting space, as viewed with respect to a direction of flight of the projectile, is located behind the boundary portion and has a depth that corresponds to at least twice the thickness of the boundary portion.

5. The igniter according to claim 1, wherein a peripheral edge of the disk-shaped element abuts with clearance against side walls of the collecting space in the first position.

6. The igniter according to claim 1, wherein a securing device is provided for the disk-shaped element in the second position in which such disk-shaped element rests of in the collecting space.

7. The igniter according to claim 1, wherein the central portion and the boundary portion have a center of mass (S) which is located eccentrically to an axis of rotation (A) of the projectile.

8. The igniter according to claim 1, wherein the disk-shaped element is circular.

9. The igniter according to claim 1, wherein the disk-shaped element consists of a plastic material.

10. An The igniter according to claim 1, wherein the rated breaking point is formed by reducing a thickness of a material of the disk-shaped element.

11. The igniter according to claim 1, wherein the central portion and the boundary portion of the disk-shaped element are connected with each other by webs that form the rated breaking point.

12. The igniter according to claim 1, wherein a central portion and a boundary portion are in each case individual elements which are connected with each other by a connecting element that forms the rated breaking point.

13. The igniter according to claim 12, wherein the connecting element is a self-adhesive film.

14. The igniter according to claim 6, wherein the securing device is a clamping device.

15. The igniter according to claim 1, wherein the disk-shaped element is rectangular.

* * * * *